US009463355B2

(12) United States Patent
Davis

(10) Patent No.: US 9,463,355 B2
(45) Date of Patent: Oct. 11, 2016

(54) THERAPEUTIC GLOVES AND THEIR COMPONENTS

(71) Applicant: Rufus Davis, Houston, TX (US)

(72) Inventor: Rufus Davis, Houston, TX (US)

( * ) Notice: Subject to any disclaimer, the term of this patent is extended or adjusted under 35 U.S.C. 154(b) by 0 days.

(21) Appl. No.: 14/216,056

(22) Filed: Mar. 17, 2014

(65) Prior Publication Data

US 2015/0258369 A1 Sep. 17, 2015

(51) Int. Cl.
*A63B 23/16* (2006.01)
*A63B 21/055* (2006.01)

(52) U.S. Cl.
CPC ..... *A63B 23/16* (2013.01); *A63B 21/0552* (2013.01); *A63B 21/4019* (2015.10); *A63B 21/4025* (2015.10); *A63B 21/4035* (2015.10); *A63B 21/4043* (2015.10)

(58) Field of Classification Search
CPC .. A63B 23/16; A63B 21/02; A63B 21/0552; A63B 71/14; A63B 71/141; A63B 71/143; A63B 71/145; A63B 71/146; A63B 71/148; A63B 21/04; A63B 21/4019; A63B 21/4021; A63B 21/4017; A63B 21/4035; A63B 21/4039; A63B 21/16; A41D 19/00; A41D 19/0006; A41D 19/001; A61H 1/00; A61H 1/02; A61H 1/0285; A61H 1/0288; A61H 2201/00; A61H 2201/0153; A61H 2201/0157; A61H 2201/16; A61H 2201/1635; A61H 2201/1638; A61H 2205/00; A61H 2205/065; A61H 2205/067
See application file for complete search history.

(56) References Cited

U.S. PATENT DOCUMENTS

| | | | | |
|---|---|---|---|---|
| 3,347,547 | A * | 10/1967 | Hynes | 482/47 |
| 3,944,220 | A * | 3/1976 | Fasano | A63B 21/0552 2/159 |
| 4,000,524 | A | 1/1977 | Rinehart | |
| 5,373,585 | A * | 12/1994 | Wiggins | 2/159 |
| 5,447,490 | A | 9/1995 | Fula et al. | |
| 5,476,439 | A * | 12/1995 | Robinson | 601/40 |
| 5,697,103 | A * | 12/1997 | Wiggins | A41D 19/00 2/159 |
| 6,059,694 | A * | 5/2000 | Villepigue | A63B 21/0004 294/25 |
| 6,450,924 | B1 | 9/2002 | Block | |
| 7,731,633 | B1 | 6/2010 | Williams | |
| 8,348,810 | B2 * | 1/2013 | Land | A63B 21/00065 482/47 |
| 8,491,447 | B1 * | 7/2013 | Koranic | A63B 21/0421 482/44 |
| 8,601,614 | B2 * | 12/2013 | Scaff | A41D 19/00 2/160 |
| 2012/0317693 | A1 | 12/2012 | Hatz | |
| 2014/0287882 | A1 * | 9/2014 | Barner | A63B 23/16 482/47 |
| 2015/0141206 | A1 * | 5/2015 | James, Jr. | A63B 23/16 482/47 |

FOREIGN PATENT DOCUMENTS

WO WO 97/00027 A1 1/1997

* cited by examiner

*Primary Examiner* — Oren Ginsberg
*Assistant Examiner* — Megan Anderson
(74) *Attorney, Agent, or Firm* — Haynes and Boone, LLP

(57) ABSTRACT

A therapeutic glove includes two glove bodies. The hand is inserted into the inner body (310), which is shaped like a glove. The outer body (320) can also be like a glove or part of a glove, but the outer body's back side can be pulled towards the wrist and attached to the inner body to adjust the glove tension. In some embodiments, the glove has a single body or multiple bodies, and the glove creates a force that pushes the fingers (or at least some fingers) to a straight position away from the palm. In some embodiments, the glove is thinner on the palm side than the back side. Other embodiments are also provided.

23 Claims, 9 Drawing Sheets

UNSECURED GLOVE,
BACK SIDE

INNER GLOVE BODY,
BACK SIDE

OUTER GLOVE BODY,
BACK SIDE, FLAP BENT
OUTWARD

UNSECURED GLOVE,
BACK SIDE

INNER GLOVE BODY,
FRONT SIDE

OUTER GLOVE BODY,
FRONT VIEW

UNSECURED GLOVE,
FRONT SIDE

SECURED GLOVE,
BACK SIDE

SECURED GLOVE,
FRONT SIDE

THERAPEUTIC GLOVES AND THEIR COMPONENTS

BACKGROUND OF THE INVENTION

The present invention relates to therapeutic gloves.

Therapeutic gloves help to exercise hand and arm muscles that control finger movement. Strengthening of these muscles provides relief for arthritis and hand injuries such as may result, for example, from excessive finger strain common in occupations requiring precise finger movement. Typists, barbers, cooks, and musicians are examples of such occupations. Muscle strengthening is also desirable to alleviate problems caused by inadequate exercise or aging process. A therapeutic glove strengthens the muscles by offering resistance to the hand and finger bending in finger exercises.

FIG. 1 illustrates some features of a glove described in PCT application no. WO 97/00027 by Wiggins, published 3 Jan. 1997. Increased resistance to finger bending is provided by elastic bands 110 positioned in channels formed in the glove's fingers 114 below the surface of the glove body. Each band 110 is attached to a respective ring 120 at the tip of the respective finger, and is also attached to a respective "anchor rod means" 130 near the knuckles. When the hand's (and glove's) fingers are closed, the elastic bands 110 are stretched, exerting a reverse counterforce, pulling the fingers "back straight so as to open the hand and aid in exercising the fingers" (see page 18, first paragraph of the PCT application).

Elastic bands 140 are attached between respective anchor rod means 130 and a retaining tab 150. Each band pair 140, 110 attached to the same anchor rod means 130 may or may not be part of a continuous band. Retaining tab 150 can be attached to an adjustment strap 160 at the wrist portion of the glove. Adjustment strap 160 has hook-and-loop fasteners (not shown) so that it can be fastened tight around the user's wrist. Before being attached to strap 160, tab 150 can be pulled to a comfortable position according to the hand's size. Tab 150 is then attached to strap 160 by hook-and-loop fasteners (not shown), which may or may not provide additional tension.

FIG. 2 shows a finger of another glove, described in U.S. Pat. No. 6,450,924 issued 17 Sep. 2002 to Block. This glove advantageously allows the user to adjust the resistance to finger motion and to target specific fingers for exercise. The resistance is controlled by resilient members 210 placed above (or below) the glove's fingers 114. The resistance is adjusted by "complimentary interlocking fastening members" at the ends 210E of the resilient members 210.

Alternative glove designs are desirable.

SUMMARY

This section summarizes some features of the invention. Other features may be described in the subsequent sections. The invention is defined by the appended claims, which are incorporated into this section by reference.

Some embodiments of the present invention include gloves of simple construction while providing adjustable resistance and the option to target individual fingers. Further, in some embodiments, the resistance can be spread more uniformly over the hand, and can be provided for hand movements other than finger bending, e.g. when the hand is arched longitudinally without finger bending (for example, when the unbent thumb is brought close to the little finger or the ring finger).

In some embodiments, the glove can be worn permanently, e.g. during work performance, and not just in hand exercises.

In some embodiments, the glove includes two glove bodies. The hand is inserted into the inner glove body, which itself is shaped like a glove. The outer glove body can also be similar to a glove, but the outer glove body's back side can be pulled towards the wrist and attached to the inner glove body in a desired position to adjust the glove tension. In some embodiments, the outer glove body spreads the tension over the back of the hand, and provides counterforce not only to finger bending but also to other types of hand arching such as may be present when the glove is worn permanently at work or on other occasions.

In some embodiments, the glove creates a force that pushes the fingers to a straight position away from the palm. The straight position is not a relaxed position because in the relaxed position when no glove is worn, the fingers are slightly bent forward, i.e. towards the palm. For simplicity, the force pushing the fingers farther backward than the relaxed position will be called "back-pushing force" herein. The back-pushing force is believed to be therapeutically beneficial. However, the invention is not limited to any theory regarding therapeutic advantages.

In some embodiments, the total glove thickness (i.e. the combined thickness of the inner and outer glove bodies) is smaller on the palm side than on the back side. Also, the back-pushing force is provided by the elasticity of the glove's back side while the thinner palm side does not contribute much to the back-pushing force and does not provide much resistance to finger closing. This is also believed to be therapeutically beneficial and to provide good feeling to the hand when the glove is worn. However, as noted above, the invention is not limited to any theory regarding therapeutic advantages, nor is it limited to any theory as to what provides better feeling to the hand, especially since the therapeutic advantages and the feeling may vary from person to person or from time to time for the same person.

In some embodiments, the glove has a single body. The back side is elastic, and is thicker than the palm side, to provide the benefits described above. Thus, the invention includes single-body and multi-body gloves.

Moreover, the glove can be combined (and worn simultaneously) with other types of gloves, e.g. it can be worn underneath a heat resistant glove described in U.S. patent application of Hatz published as US 2012/0317693 on Dec. 20, 2012 and incorporated herein by reference.

The invention is not limited to the features and advantages described above. For example, in some embodiments, the glove's back side contains an elastic portion but is not elastic throughout. Other embodiments and variations are within the scope of the invention which is defined by the appended claims.

DESCRIPTION OF SOME EMBODIMENTS

The embodiments described in this section illustrate but do not limit the invention. The invention is defined by the appended claims.

Figure 1:
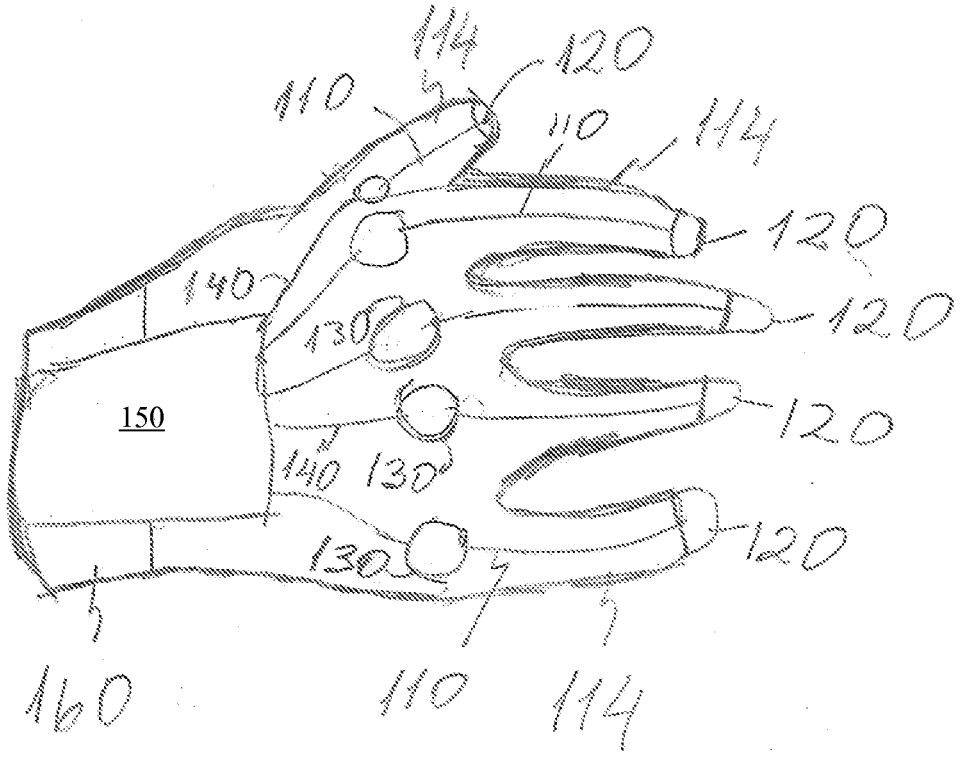
FIG. 1 PRIOR ART
FIGS. 1 and 2 illustrate prior art therapeutic gloves.
Figure 2:
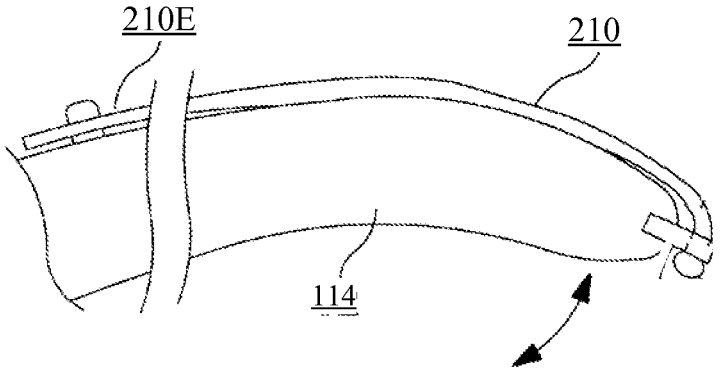
FIG. 2 PRIOR ART
Figure 3A:
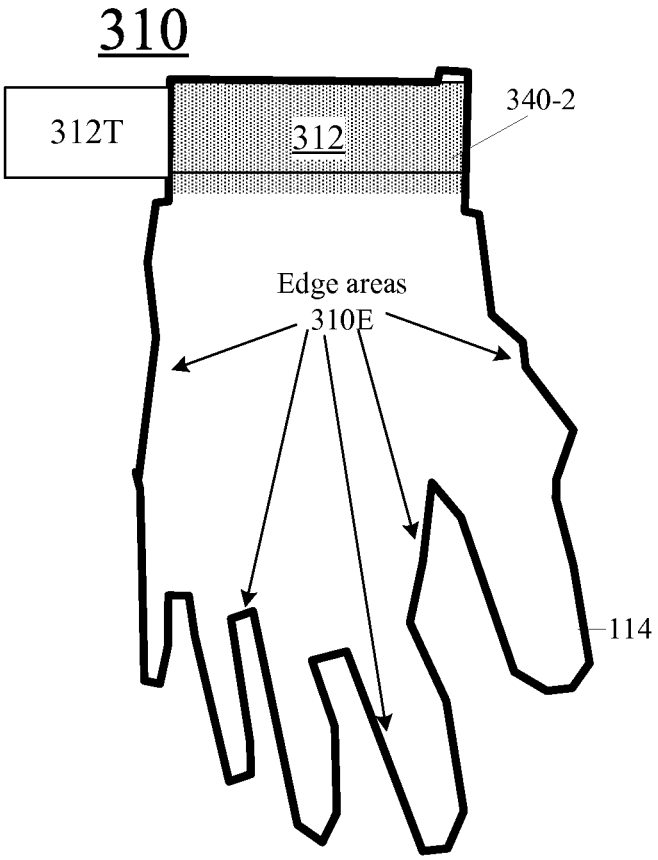
FIGS. 3A, 3B, 3C, 4A, 4B, 4C, 5, 6 illustrate therapeutic gloves and their components according to some embodiments of the present invention.
Figure 3B:
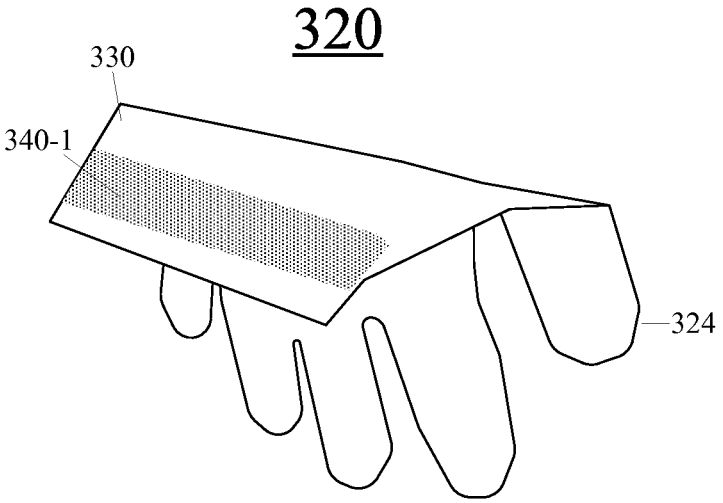
Figure 3C:
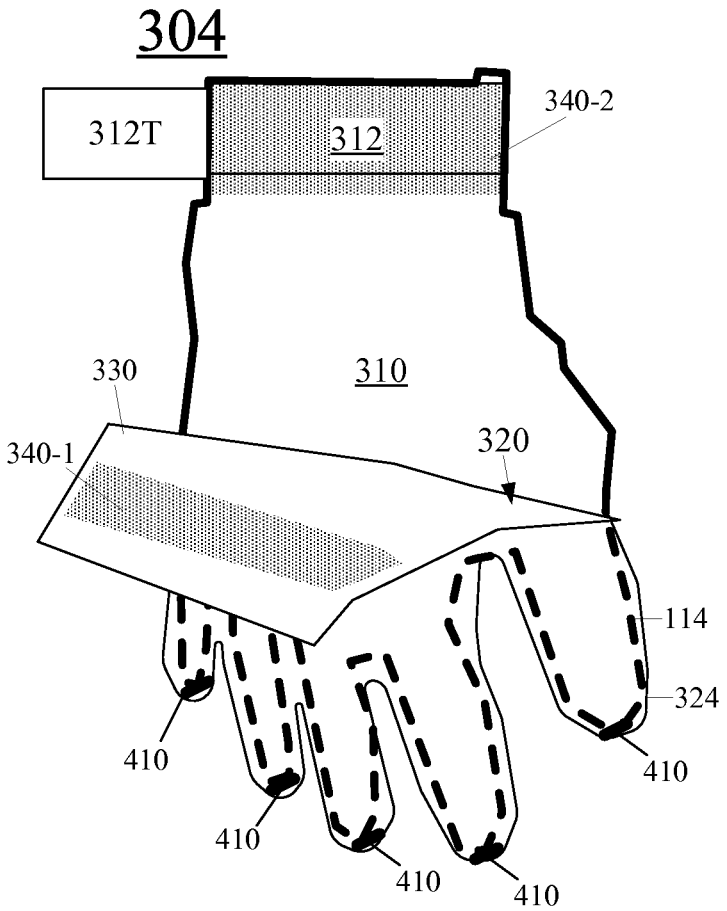
Figure 4A:
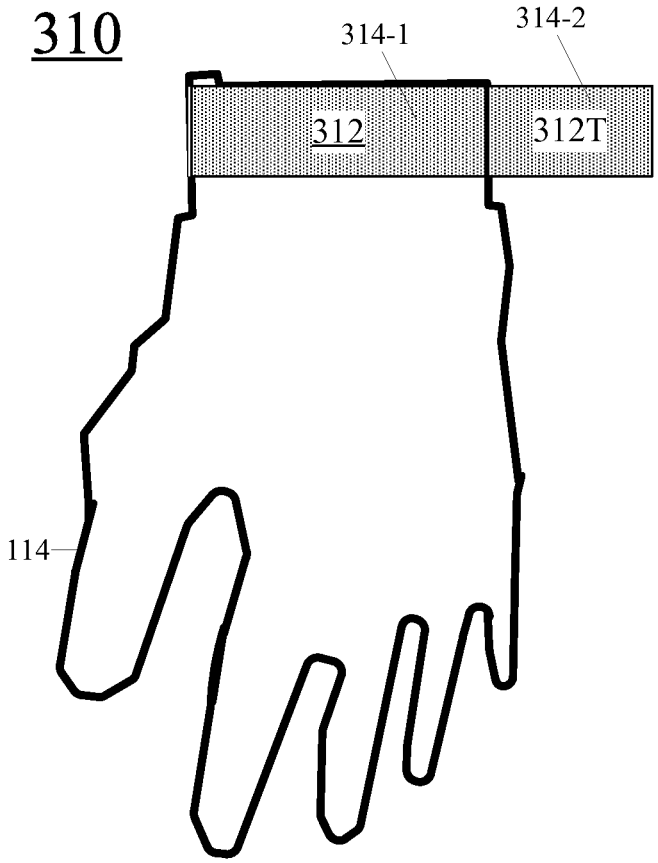
Figure 4B:
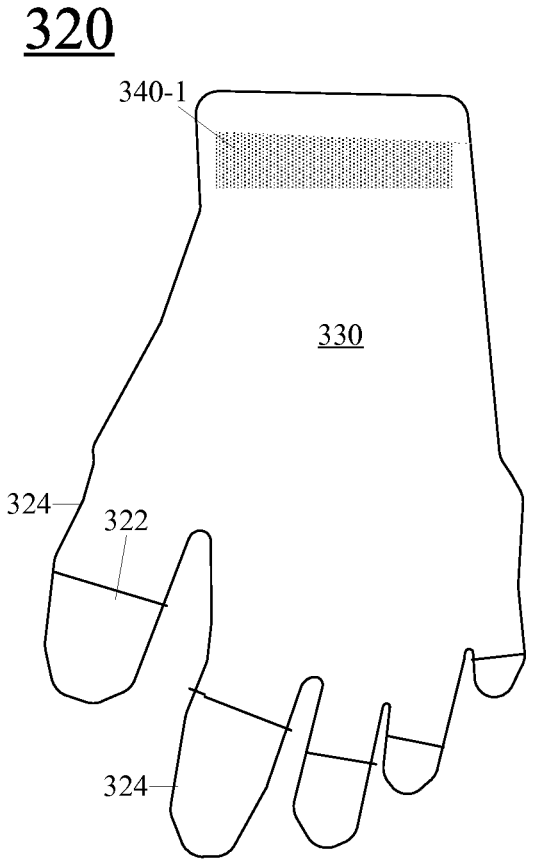
Figure 4C:
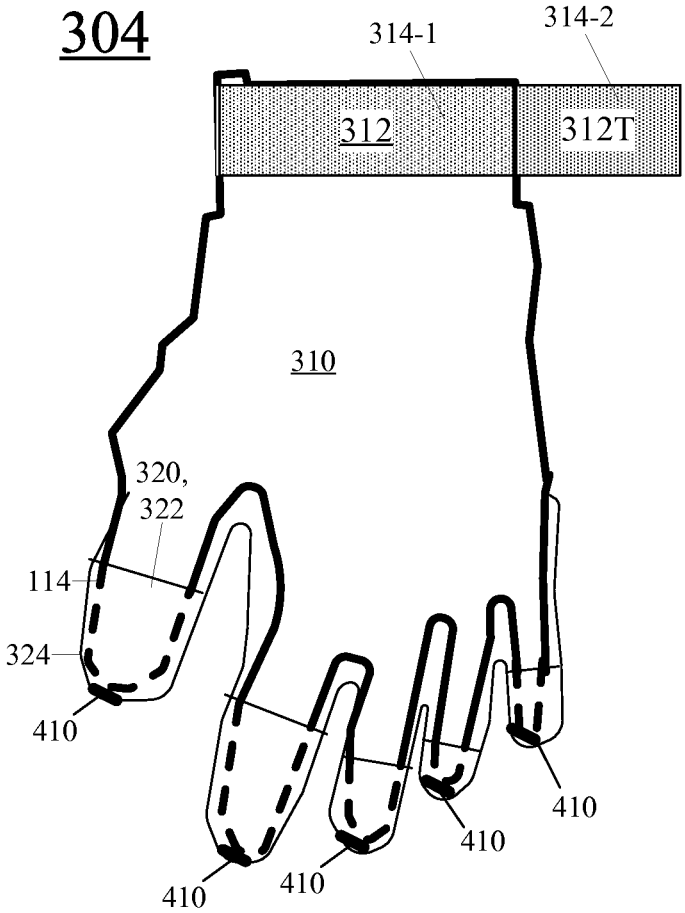
Figure 5:
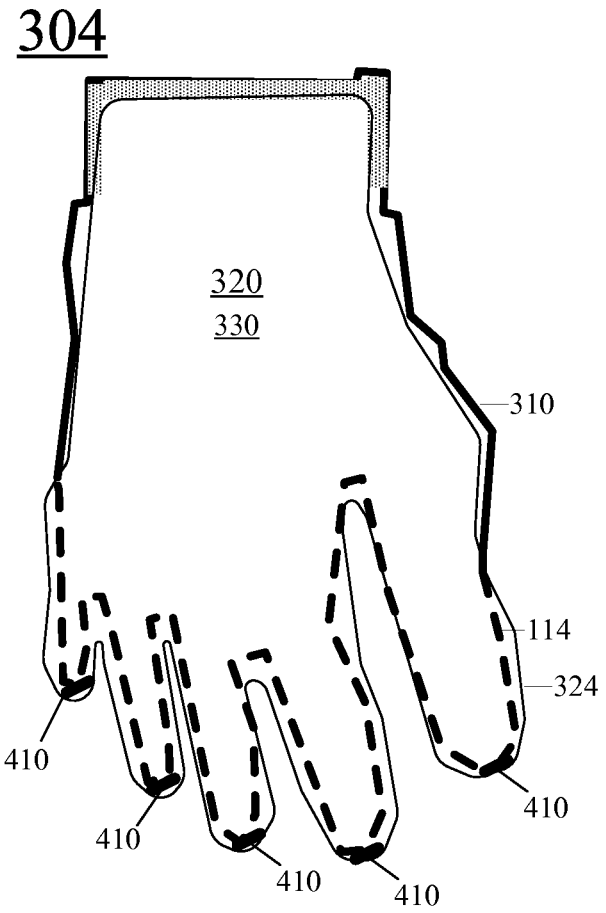
Figure 6:
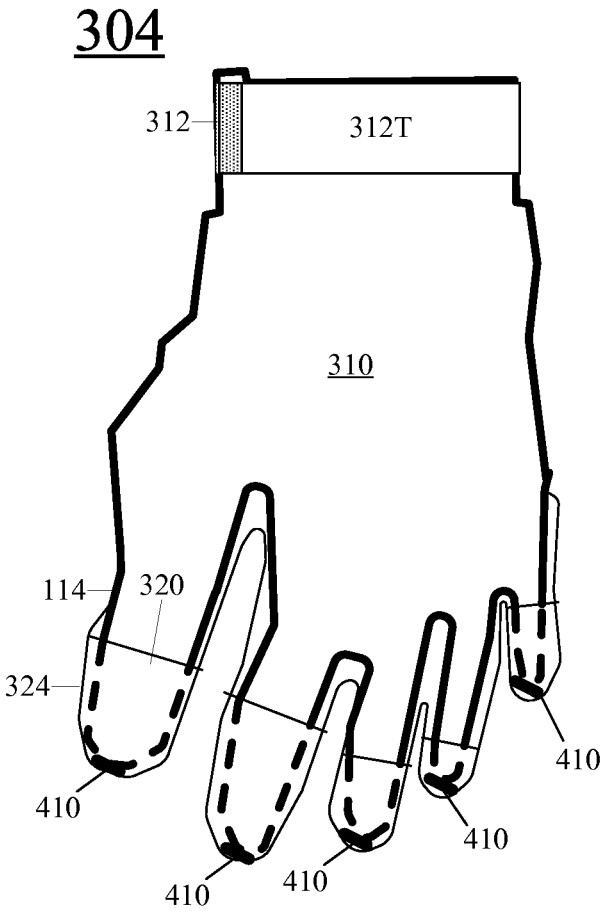

FIGS. 3A, 3B, 3C, 4A, 4B, 4C, 5, 6 illustrate a therapeutic glove 304 according to some embodiments of the present invention. Glove 304 includes an inner glove body 310 and an outer glove body 320. FIGS. 3A, 3B, 3C illustrate the back (i.e. dorsal) view of inner glove body 310, outer glove body 320, and the glove 304 respectively when the glove is not secured on a hand. FIGS. 4A, 4B, 4C illustrate the front (i.e. palm-side) view of inner glove body 310, outer glove body 320, and the glove 304 respectively when the glove is not secured on a hand. In FIGS. 5 (back view) and 6 (front view) the glove 304 is secured on a hand by suitable fasteners as described below (the hand is not shown). This is a right-hand glove, but a symmetric left-hand glove can also be provided.

Inner glove body 310 is itself shaped like a glove. Inner glove body 310 can be any type of glove, including prior art therapeutic or non-therapeutic gloves. In some embodiments, inner glove body 310 is a therapeutic glove made of rubber or other elastic material. The rubber or other material may (or may not) be sufficiently thick on the palm side of the hand to create perceptible resistance when closing the hand and thus to help exercise the pertinent muscles. The rubber or other material is sufficiently thick on the back side of the hand to create perceptible resistance when closing the hand and thus to help exercise the pertinent muscles. The rubber or other material on the glove's back side, and possibly on the palm side, creates a force ("back-pushing force") that pushes the fingers backwards from the closed position to their relaxed position. In the relaxed position, the fingers are slightly bent forward, towards the palm. In some embodiments, the back-pushing force pushes the fingers even further, to the straight-palm-and-fingers position ("straight position"). In some embodiments, the back-pushing force pushes all the fingers to the straight position. In other embodiments, the back-pushing force pushes only some fingers, e.g. all the fingers other than the thumb, to the straight position.

The back-pushing force can be created by a suitable choice of materials and/or the glove shape. In some embodiments, the back-pushing force can be increased by making the inner glove body harder to stretch on the back side. "Harder to stretch" refers to the force which restores the material to the original state for a given deformed state and a given original (pre-deformed) state; "harder to stretch" means that this force is greater. In some embodiments, the back and palm sides are made from the same material (e.g. rubber), and the material is sufficiently thick on the back side to provide a desired back-pushing force. In other embodiments, only part of the back side is elastic, e.g. only the fingers or only part of the fingers.

The palm side may or may not be elastic. It is believed that at least for some people, it is better if the palm side is thin and does not provide much resistance to finger closing. It is believed that such a glove may be therapeutically beneficial and/or may provide a better feel to the user. (As noted above, the invention is not limited to any theory regarding therapeutic or feeling advantages.)

In some embodiments for example, the whole inner glove body is made of rubber which is at least twice as thick on the back side, or a part of the back side, as the palm side; for example, in some embodiments the inner glove body's average thickness over the back side is higher than over the palm side. The inner glove body can be "in a straight line" when it is not worn, i.e. can be symmetric with respect to back and palm sides except for the greater thickness on the back. For example, the inner glove body's fingers can be thicker on the back side than on the palm side, while the rest (the non-finger portion) of the inner glove body can be of uniform thickness. In other embodiments, the thicker part is the entire back side part between the fingertips and the knuckles, or between the fingertips and the thumb base of the inner glove body.

Other techniques can be used to create the back-pushing force for the fingers. For example, the back side can be shorter from the finger tips to the wrist, or from the finger tips to the thumb base, than the palm side. Different techniques described above can be combined. In some embodiments, the back-pushing force can be provided for all the fingers or any one or more of the fingers. The invention is not limited to the presence of the back-pushing force.

Inner glove body 310 can be secured on the wrist in any suitable manner, e.g. by a strap with a buckle, or by compression, or in some other way. In the particular embodiment shown, inner glove body 310 has wrist strap 312 wrapping around the wrist and having an extension (a tab) 312T (FIGS. 3A, 3C, 4A, 4C, 6) attachable to the strap on the wrist's front side (palm side) when the strap has been wrapped around and tightened. (In FIG. 6, the tab 312T is attached to the strap.) In this embodiment, the attachment is performed with a hook-and-loop fastener 314 shown in FIGS. 4A and 4C as 314-1 on tab 312T and 314-2 on the strap portion on the wrist front. Fastener portion 314-1 includes the hooks or the loops, and complimentary fastener portion 314-2 includes the loops or the hooks respectively.

Outer glove body 320 has an elastic back side portion, or the entire back side is elastic. The palm side may or may not have an elastic portion, and may be entirely elastic. Outer glove body 320 may or may not form a complete glove. In the embodiment shown in FIGS. 4B and 6, outer glove body 320 covers the distal portions of fingers 114 of inner glove body 310 but does not cover the palm. Fingers 114 of inner glove body 310 are inserted into pockets 322 formed by respective fingers 324 of outer glove body 320. The portions of fingers 114 covered by fingers 324 are shown by dotted lines. In some embodiments, outer fingers 324 cover one or more inner fingers 114 entirely, and may cover part or all of the palm.

As shown in FIGS. 3B, 4B, and 5, the back side of outer glove body 320 includes a flap 330 extending from the fingers 324 towards the wrist. The flap can be pulled towards the wrist to achieve a desired glove tension, and the flap can then be attached to inner glove body 310. In this particular embodiment, the attachment is hook-and-loop (e.g. Velcro®): flap 330 has hooks or loops 340-1 on the inner side (the side facing the inner glove body 310), and inner glove body 310 has matching loops or hooks 340-2 on the outer side. The loops or hooks 340-2 can be provided on wrist strap 312 and/or the body 310 portion below the wrist strap (i.e. between the wrist strap and the fingers) as desired.

Of note, the back-pushing force described above in connection with the inner glove body 310 can alternatively (or in addition) be created by outer glove body 320, and can be created by stretching the flap 330 farther towards the wrist. Thus, some embodiments do not create the back-pushing force except when the user pulls the flap 330 sufficiently far towards the wrist. This advantageously provides the user with more control regarding the type of force acting on the fingers.

In some embodiments, outer glove body 320 is attached to inner glove body 310 by glue, stitches, buttons (and button-holes), or in some other way. In FIGS. 3A-6, the attachments are shown at 410. The attachments are at the finger tips or on the front side; the whole back side of body 320 can move relative to body 310 to adjust the glove tension when the flap 330 is pulled towards the wrist as described above. Attachments 410 may extend slightly to the front side so as not to interfere with glove tension adjustment.

In other embodiments, the outer glove body 320 is not permanently attached to inner glove body 310 (the attachment is only by fastener 340 (340-1, 340-2)). If there are no permanent attachment, or the attachment is detachable and re-attachable (as in the case of buttons), then the outer glove body 320 can be easily separated from inner glove body 310. Such easy separability facilitates glove repairs. In addition, it becomes easier to use the inner glove body 310 with different outer glove bodies 320 or use the same outer glove body 320 with different inner glove bodies 310, as needed to provide a suitable range of resistances to finger motion and other types of hand motion, or suitable heat resistance, chemical inertness, or other properties for a particular environment, or for any other reason. In addition, the user's fingers can be exercised selectively; for example, only some but not all of the inner fingers 114 can be inserted into respective outer fingers 324. The corresponding user fingers will experience resistance from inner glove body 310 and outer glove body 320, but the remaining fingers will only experience resistance from the inner glove body 310.

The glove can be used as follows. The user inserts the hand into the wrist opening of inner glove body 310. For convenience, the hand can be stretched out during this operation, with the fingers and the palm being in a straight line. The user then fastens the strap 312 to secure the inner glove body on the hand. Outer glove body 320 can be placed onto the hand at any stage, before or after fastening the strap 312. Of course, if the inner and outer bodies are permanently attached together, then both are put on simultaneously.

Then the user pulls flap 330 towards the wrist to the desired tension, and fastens the flap to inner glove body 310 (with fasteners 340 for example). The glove can now be used as desired, for exercise, work, or other wear.

The outer glove body provides more uniform resistance to finger bending and hand arching.

The invention is not limited to the embodiments described above. For example, non-hook-and-loop fasteners can be used for fasteners 314 and 340. In some embodiments, fastener 314 is hook-and-loop type, and the hook-or-loop area 314-1 extends at least one half of the width of the outer glove body 320. The width is measured perpendicularly to the fingers at the location of fastener portion 314-1. The area 314-1 may extend the entire width of outer glove body 320. In some embodiments, all of area 314-1 is attached to area 314-2. More uniform resistance over the back of the hand is thus provided.

In some embodiments, when the inner glove body 310 is inserted into outer glove body 320, the back side of the outer glove body extends over the whole width of the inner glove body at each finger. Also, the back side of the outer glove body extends over the whole width of the inner glove body at the palm's one or more transversal regions covered by the outer glove body. A palm's transversal region is any region on the palm side such that the region extends perpendicularly to the fingers and is positioned between the non-thumb fingers and the wrist; it can be positioned between the thumb and the wrist. The width is measured perpendicularly to the fingers. In some embodiments, the outer glove body does not cover the whole width at the fingers and the palm's transversal regions covered by the outer glove body, but the outer glove body covers at least half of the width. In some embodiments, the outer glove body covers the whole width except possibly for some of the edge areas 310E (FIG. 3A) of the inner glove body. The edge areas 310E are at most 5 mm wide at the fingers and at most 10 mm wide at the palm. Such wide coverage helps obtain more uniform resistance to hand motion.

Outer glove body 320 may or may not be made of the same material or materials as inner glove body 310. In some embodiments, outer glove body 320 is easier to stretch; for example, in some embodiments, outer glove body 320 and inner glove body 310 are made of the same material (e.g. rubber), but outer glove body 320 is thinner. Inner glove body 310 may or may not have increased thickness on the back side. Such embodiments are not limiting.

Some embodiments provide a single-body therapeutic glove which consists of just the inner glove body 310. The glove is made of an elastic material such as described above, e.g. the material that creates a back-pushing force pushing the fingers towards the back to the straight-palm-and-fingers position. In some embodiments, the back-pushing force is provided for all the fingers. In other embodiments, the back-pushing force is provided for less than all the fingers, e.g. for all the fingers other than the thumb. The back-pushing force may or may not be sufficiently large to move the fingers into the straight position, but the force is noticeable to a human being so as to provide support for the fingers when they are relaxed. In some embodiments, only part of the glove is elastic, e.g. only the back side or only a portion of the back side is elastic, as explained above for the inner glove body of the two-body glove. In some embodiments, the glove thickness on the palm side is less than on the back side. Therefore, the back-pushing force is provided by the elasticity of the glove's back side while the thinner palm side does not provide much resistance to finger closing. For example, in some embodiments, the glove is elastic (e.g. all rubber), but the glove's back side (or back side's portion) is at least twice thicker than the palm side, or the glove's average thickness on the back side is at least twice greater than on the palm side. For example, the finger portion can be at least twice thicker on the back side than on the palm side, and the rest of the glove can be made of uniform thickness. The thicker portion on the back side may include fingers or the region from the finger tips to the knuckles on the back side. The glove may have any features or combination of features described above for the inner glove body 310 of the two-body glove.

Other embodiments and variations are within the scope of the invention, as defined by the appended claims.

The invention claimed is:

1. An outer glove body for a therapeutic glove, the outer glove body comprising a plurality of fingers for receiving fingers of an inner glove body of the therapeutic glove, the inner glove body's fingers being for receiving a user's hand's fingers;

wherein a back side of the outer glove body comprises elastic material, and the back side of the outer glove body comprises a wrist end opposite to fingertips of the outer glove body's fingers, wherein the wrist end can be pulled towards the user's wrist to control the therapeutic glove's tension when the therapeutic glove is worn by the user;

wherein the outer glove body comprises at least part of a first fastener for fastening the back side of the outer glove body to the inner glove body when the inner glove body is inserted into the outer glove body and when the desired tension is achieved by pulling the wrist end of the outer glove body towards the user's wrist when the therapeutic glove is worn by the user;

wherein each finger of the plurality of fingers of the outer glove body comprises a pocket at the finger's tip, each pocket being for receiving a corresponding finger of the inner glove body, the pocket to cover and encircle a segment of the corresponding finger of the inner glove body;

wherein the outer glove body is configured not to cover a palm of the inner glove body.

2. The outer glove body of claim 1 wherein the entire back side of the outer glove body is elastic.

3. The outer glove body of claim 1 wherein the entire outer glove body is elastic.

4. The outer glove body of claim 1 wherein the first fastener is a hook-and-loop fastener, and the part of the first fastener on the outer glove body extends to at least one half of a width of the outer glove body, the width being measured perpendicularly to the fingers at a location of the at least said part of the first fastener.

5. The outer glove body of claim 1, wherein the part of the first fastener extends over a whole width of the outer glove body.

6. A therapeutic glove comprising:

an inner glove body into which a user's hand can be inserted, the inner glove body comprising a plurality of fingers for receiving the hand's fingers, the inner glove body comprising a palm side and a back side opposite to the palm side;

an outer glove body into which the inner glove body is inserted when the therapeutic glove is worn, the outer glove body comprising a plurality of fingers for receiving the inner glove body's fingers;

wherein at least a part of a back side of the outer glove body is elastic, and the back side of the outer glove body comprises a wrist end opposite to fingertips of the outer glove body's fingers, wherein the wrist end can be pulled towards the therapeutic glove's wrist to control the therapeutic glove's tension when the therapeutic glove is worn by the user;

wherein the therapeutic glove further comprises a first fastener for fastening the back side of the outer glove body to the inner glove body when the desired tension is achieved by pulling the wrist end of the outer glove body towards the therapeutic glove's wrist, wherein the outer glove body comprises at least a part of the first fastener;

wherein each finger of the plurality of fingers of the outer glove body comprises a pocket at the finger's tip, each pocket being for receiving a corresponding finger of the inner glove body, the pocket to cover and encircle a segment of the corresponding finger of the inner glove body;

wherein the outer glove body is configured not to cover a palm of the inner glove body.

7. The therapeutic glove of claim 6 wherein when all of the plurality of fingers of the inner glove body are inserted into the outer glove body, the back side of the outer glove body extends over the whole width (measured perpendicularly to the fingers) of the inner glove body at each finger of the plurality of fingers of the inner glove body and at one or more transversal regions of the inner glove body, each transversal region being between the fingers other than a thumb of the inner glove body and the wrist of the inner glove body, except that the back side of the outer glove body does or does not cover one or more edge areas of the inner glove body, each of the one or more edge areas being at a finger edge of the inner glove body or at a palm edge of the inner glove body.

8. The therapeutic glove of claim 7 wherein said one or more transversal regions are between the thumb and the wrist.

9. The therapeutic glove of claim 6 wherein the entire back side of the outer glove body is elastic.

10. The therapeutic glove of claim 6 wherein the entire outer glove body is elastic.

11. The therapeutic glove of claim 6 wherein when all of the plurality of fingers of the inner glove body are inserted into the outer glove body, at least a portion of the therapeutic glove's back side is thicker than at least a portion of the therapeutic glove's palm side.

12. The therapeutic glove of claim 6 wherein when all of the plurality of fingers of the inner glove body are inserted into the outer glove body, at least a portion of the glove's back side is at least twice as thick as at least a portion of the therapeutic glove's palm side.

13. The therapeutic glove of claim 6 wherein when all of the plurality of fingers of the inner glove body are inserted into the outer glove body, the average thickness of the therapeutic glove's back side is at least twice greater than the average thickness of the therapeutic glove's palm side.

14. The therapeutic glove of claim 6 wherein when all of the plurality of fingers of the inner glove body are inserted into the outer glove body, the back side of the outer glove body extends over at least half of the width (measured perpendicularly to the fingers) of the inner glove body at each finger and at the one or more transversal regions.

15. The therapeutic glove of claim 6 wherein on the palm side, the outer glove body covers at least a portion of the fingers of the inner glove body but does not cover any non-finger portion of the inner glove body.

16. The therapeutic glove of claim 6 wherein the first fastener comprises a hook-and-loop fastener.

17. The therapeutic glove of claim 6 wherein the inner glove body comprises a second fastener for securing the inner glove body on the hand.

18. The therapeutic glove of claim 6 wherein the first fastener is a hook-and-loop fastener, and the at least said part of the first fastener on the outer glove body extends over at least one half of a width of the outer glove body, the width being measured perpendicularly to the fingers at a location of the at least said part of the first fastener.

19. The therapeutic glove of claim 6 wherein the at least said part of the first fastener extends over the whole width of the outer glove body.

20. The therapeutic glove of claim 6 wherein the outer glove body is at least as wide as the inner glove body.

21. An outer glove body for a therapeutic glove, the outer glove body comprising a plurality of fingers for receiving fingers of an inner glove body of the therapeutic glove, the inner glove body's fingers being for receiving a user's hand's fingers;

wherein a back side of the outer glove body comprises elastic material, and the back side of the outer glove body comprises a wrist end opposite to fingertips of the outer glove body's fingers, wherein the wrist end can be pulled towards the user's wrist to control the therapeutic glove's tension when the therapeutic glove is worn by the user;

wherein the outer glove body comprises at least part of a first fastener for fastening the back side of the outer glove body to the inner glove body when the inner glove body is inserted into the outer glove body and when the desired tension is achieved by pulling the wrist end of the outer glove body towards the user's wrist when the therapeutic glove is worn by the user;

wherein the outer glove body comprises an elastic portion comprising the elastic material and configured to cover substantially an entire width of a back side of the hand at least between the hand's fingers and an area adjacent to the hand's wrist, to improve uniformity of resistance to longitudinal arching of the hand.

22. An outer glove body for a therapeutic glove, the outer glove body comprising a plurality of fingers for receiving fingers of an inner glove body of the therapeutic glove, the inner glove body's fingers being for receiving a user's hand's fingers;

wherein a back side of the outer glove body comprises elastic material, and the back side of the outer glove body comprises a wrist end opposite to fingertips of the outer glove body's fingers, wherein the wrist end can be pulled towards the user's wrist to control the therapeutic glove's tension when the therapeutic glove is worn by the user;

wherein the outer glove body comprises at least part of a first fastener for fastening the back side of the outer glove body to the inner glove body when the inner glove body is inserted into the outer glove body and when the desired tension is achieved by pulling the wrist end of the outer glove body towards the user's wrist when the therapeutic glove is worn by the user;

wherein the outer glove body is configured to cover an entire back side of the hand.

23. A therapeutic glove comprising:

an inner glove body into which a user's hand can be inserted, the inner glove body comprising a plurality of fingers for receiving the hand's fingers, the inner glove body comprising a palm side and a back side opposite to the palm side;

an outer glove body into which the inner glove body is inserted when the therapeutic glove is worn, the outer glove body comprising a plurality of fingers for receiving the inner glove body's fingers;

wherein at least a part of a back side of the outer glove body is elastic, and the back side of the outer glove body comprises a wrist end opposite to fingertips of the outer glove body's fingers, wherein the wrist end can be pulled towards the therapeutic glove's wrist to control the therapeutic glove's tension when the therapeutic glove is worn by the user;

wherein the therapeutic glove further comprises a first fastener for fastening the back side of the outer glove body to the inner glove body when the desired tension is achieved by pulling the wrist end of the outer glove body towards the therapeutic glove's wrist, wherein the outer glove body comprises at least a part of the first fastener;

wherein the outer glove body comprises an elastic portion configured to cover substantially an entire portion of the back side of the inner glove body extending from the fingers of the inner glove body towards the wrist of the inner glove body, to provide resistance to longitudinal arching of the hand.

* * * * *